US010201966B2

(12) United States Patent
Shneider et al.

(10) Patent No.: US 10,201,966 B2
(45) Date of Patent: Feb. 12, 2019

(54) SYSTEM AND METHOD FOR PAD PRINTING

(71) Applicant: Technion Research & Development Foundation Limited, Haifa (IL)

(72) Inventors: Yacov Shneider, Nesher (IL); Orna Ternyak, Migdal Ha'Emeq (IL); Svetlana Yofis, Haifa (IL)

(73) Assignee: TECHNION RESEARCH AND DEVELOPMENT FOUNDATION LTD., Haifa (IL)

( * ) Notice: Subject to any disclaimer, the term of this patent is extended or adjusted under 35 U.S.C. 154(b) by 0 days.

(21) Appl. No.: 14/915,251

(22) PCT Filed: Aug. 24, 2014

(86) PCT No.: PCT/IL2014/050754

§ 371 (c)(1),
(2) Date: Feb. 29, 2016

(87) PCT Pub. No.: WO2015/029019

PCT Pub. Date: Mar. 5, 2015

(65) Prior Publication Data

US 2016/0207302 A1 Jul. 21, 2016

Related U.S. Application Data

(60) Provisional application No. 61/870,320, filed on Aug. 27, 2013.

(51) Int. Cl.
*B41F 17/00* (2006.01)

(52) U.S. Cl.
CPC ..... *B41F 17/001* (2013.01); *B41F 17/00* (2013.01)

(58) Field of Classification Search
CPC ..... B41F 17/001
See application file for complete search history.

(56) References Cited

U.S. PATENT DOCUMENTS 5,694,839 A * 12/1997 Wohl ..... B41F 17/001 101/39
5,852,972 A 12/1998 Wolstenholme
6,776,100 B2 8/2004 Cutcher
7,441,500 B2 * 10/2008 Kim ..... B41J 2/0057 101/170

(Continued)

FOREIGN PATENT DOCUMENTS

CN 1798654 5/2006
CN 102066089 5/2011

(Continued)

OTHER PUBLICATIONS

Office Action for CN Application No. 201480057768.0 dated Jun. 1, 2017.

(Continued)

*Primary Examiner* — Jill E Culler
*Assistant Examiner* — Marissa Ferguson-Samreth
(74) *Attorney, Agent, or Firm* — Pearl Cohen Zedek Latzer Baratz LLP

(57) ABSTRACT

An apparatus for pad printing includes a printing pad (12). A textured transfer member (13) is configured to be pressed alternately by the printing pad (12) against an ink carrier (17) and against a substrate (24) so as to transfer an ink pattern to the substrate.

12 Claims, 8 Drawing Sheets

(56) References Cited

U.S. PATENT DOCUMENTS

| | | | | |
|---|---|---|---|---|
| 8,633,052 | B2 * | 1/2014 | Polito | B29C 43/021 438/71 |
| 9,425,346 | B2 * | 8/2016 | Polito | B29C 43/021 |
| 2006/0213380 | A1 * | 9/2006 | Reinholdt | B41F 17/001 101/41 |
| 2008/0289521 | A1 * | 11/2008 | Clark | B41F 17/001 101/216 |
| 2013/0000500 | A1 | 1/2013 | Philipp | |
| 2013/0069204 | A1 | 3/2013 | Duffy et al. | |

FOREIGN PATENT DOCUMENTS

| | | |
|---|---|---|
| EP | 1053882 | 11/2000 |
| EP | 2366547 | 9/2011 |
| WO | WO-2013043447 | 3/2013 |

OTHER PUBLICATIONS

European Office Action for EP Application No. EP14784111.8 dated Oct. 8, 2018.

* cited by examiner

SYSTEM AND METHOD FOR PAD PRINTING

CROSS-REFERENCE TO RELATED APPLICATIONS

This application is a National Phase of International Application No. PCT/IL2014/050754, filed Aug. 24, 2014, claiming the benefit of from U.S. Provisional Patent Application No. 61/870,320, filed Aug. 27, 2013, which is hereby incorporated by reference.

FIELD OF THE INVENTION

The present invention relates to pad printing.

BACKGROUND OF THE INVENTION

Pad printing is widely used for printing content, such as text, images, logos, or patterns, on different types of substrate surfaces. For example, the substrate surface may be flat or curved. A curved surface may be convex or concave, and may have a cylindrical or spherical geometry. Objects to which pad printing may be applied include bottles or other containers, balls, handles, tubes, or other objects.

In a pad printing system, a printing plate or cliché is provided on which the content to be printed is engraved or etched. Thus, cliché includes a set of recesses or grooves in the form of the content to be printed. The cliché may be made of stainless steel, ceramic, photopolymer, or another suitable material. For example, the grooves of the cliché may be formed by chemical etching using photolithography techniques. Such chemical etching may form a rough surface within the etched groove. As another example, grooves of the cliché may be formed by, or may be further processed by, laser engraving.

During pad printing, the grooves of the cliché are filled with ink. Typically, ink is deposited on a surface of the cliché by a liquid ink supply assembly. For example, the ink may be provided from a closed ink cup or from an open inkwell via a flood bar. A doctor blade or other structure travels across the cliché surface to spread the ink so as to cover the groove structure. After the ink is spread, doctor blade is moved across the surface (e.g., in the opposite direction) to remove any excess ink that remains outside the grooves of the cliché surface.

A deformable pad is pressed against the cliché plate with the ink-filled grooves. The ink in the grooves adheres to and is transferred to the pad surface, forming a pattern of ink that duplicates the pattern formed by the grooves. For example, the pad surface may be made of silicone rubber.

The deformable pad surface with the adhered pattern of ink is pressed against the printing surface of an object or substrate. When pressed, the ink is transferred from the pad surface to the printing surface. A pad may be designed for a particular concrete type of object printing surface.

Resolution of a printed image may be limited by the quality of the grooves of the cliché, by deformation of the pad when transferring the image from the cliché to the object surface, or by adhesion of ink to the grooves of the cliché. For example, when a cliché is formed by standard techniques, groove resolution may be limited to about 20 μm. Accuracy in the depth of the grooves may be limited to about 10%. Wall roughness within the grooves may be about 0.7 μm and pattern edge roughness may about 10%.

In recent years, patterning techniques have been developed to overcome the resolution limits of photolithography.

For example, microcontact printing typically utilizes a soft polydimethylsiloxane (PDMS) mold or stamp to print ink patterns. Nanoimprint lithography forms a thickness contrast by deforming a thermoplastic polymer film under high pressure at elevated temperature. In reversal imprinting a polymer film is spin coated onto a patterned mold or stamp and is then transferred to a substrate at suitable temperature and pressure.

The size of printed area on curved surfaces may be limited by the flexibility of the pad. Thus, multiple pads may be utilized to print a single image or pattern, or a specialized pad may be made to match a particularly shaped surface. Patterns that are defined by wide grooves on the cliché (e.g., wider than about 50 μm) often result in distorted images when transferred to the object printing surface.

During pad printing, the pad, which is typically made of silicone rubber or similar polymer material, is subjected to wear that may limit its lifetime. For example, during printing, the pad may be pressed and rubbed against rough surfaces of the cliché, against sharp edges of the grooves, and against the object printing surface. Use of conductive ink or paint (e.g., DuPont 9169 silver conductor), e.g., in printing conductive grids for electromagnetic interference shielding or for photovoltaic cells, may limit the lifetimes of the pads.

SUMMARY OF THE INVENTION

There is thus provided, in accordance with some embodiments of the present invention, an apparatus for pad printing, the apparatus including: a printing pad; and a textured transfer member configured to be pressed alternately by the printing pad against an ink carrier and against a substrate so as to transfer an ink pattern to the substrate.

Furthermore, in accordance with some embodiments of the present invention, the transfer member includes a transfer membrane.

Furthermore, in accordance with some embodiments of the present invention, the membrane includes PDMS.

Furthermore, in accordance with some embodiments of the present invention, the apparatus includes a holder for holding the transfer member between the printing pad on the one hand, and the ink carrier or substrate on the other.

Furthermore, in accordance with some embodiments of the present invention, the ink carrier includes a cliché that is formed out of silicon, wherein a surface of the cliché includes grooves in the form of the pattern.

Furthermore, in accordance with some embodiments of the present invention, a groove of the grooves includes a plurality of groove components.

Furthermore, in accordance with some embodiments of the present invention, a surface of the cliché is coated to resist scratching.

Furthermore, in accordance with some embodiments of the present invention, a surface within a groove is coated to repel ink.

Furthermore, in accordance with some embodiments of the present invention, the grooves include a lithographically produced fine pattern of grooves.

Furthermore, in accordance with some embodiments of the present invention, the transfer member includes a stamp with fine protrusions in the form of the pattern, the protrusions of the pattern substantially replicating a lithographically produced pattern of fine grooves of a silicon mold on which the stamp was spin coated.

Furthermore, in accordance with some embodiments of the present invention, a surface of a protrusion of the protrusions is textured in a manner that substantially replicates texturing of a groove of the grooves.

There is further provided, in accordance with some embodiments of the present invention, an apparatus for pad printing, the apparatus including: a silicon cliché including a lithographically produced fine pattern of grooves; and a printing pad that is configured to be pressed alternatively against the cliché when the grooves are filled with ink and against a substrate so as to transfer the pattern to the substrate.

Furthermore, in accordance with some embodiments of the present invention, the pattern of grooves includes a fine pattern.

Furthermore, in accordance with some embodiments of the present invention, a surface of the cliché is coated to resist scratching.

Furthermore, in accordance with some embodiments of the present invention, the apparatus further includes a transfer member to insert between the printing pad and the cliché when the pad is pressed against the cliché and between the printing pad and the substrate when the pad is pressed against the substrate.

Furthermore, in accordance with some embodiments of the present invention, the transfer member includes a transfer membrane.

Furthermore, in accordance with some embodiments of the present invention, the membrane includes PDMS.

Furthermore, in accordance with some embodiments of the present invention, a surface of the membrane is textured.

Furthermore, in accordance with some embodiments of the present invention, the transfer member includes a stamp with protrusions in the form of the pattern such that when the pad is pressed against the cliché the protrusions are inserted into the grooves of the cliché.

There is further provided, in accordance with some embodiments of the present invention, a pad printing method including: pressing a pad against a transfer member that is inserted between the pad and an ink carrier so as to press the transfer member against an ink carrier to produce an inked pattern on the transfer member; and pressing the pad against the transfer membrane when the transfer member is inserted between the pad and a substrate to print the pattern on the substrate.

Furthermore, in accordance with some embodiments of the present invention, the ink carrier includes a cliché with ink-filled grooves in the form of the pattern.

Furthermore, in accordance with some embodiments of the present invention, the cliché is formed out of silicon.

Furthermore, in accordance with some embodiments of the present invention, the method includes applying photolithography and etching to fabricate the grooves in the form of a pattern of fine grooves.

Furthermore, in accordance with some embodiments of the present invention, the method includes applying a coating to a surface of the cliché.

Furthermore, in accordance with some embodiments of the present invention, the coating includes a scratch-resistant coating or an anti-stick coating.

Furthermore, in accordance with some embodiments of the present invention, the transfer member includes a transfer membrane.

Furthermore, in accordance with some embodiments of the present invention, the method includes forming the membrane by spin coating a material on a rotating surface.

Furthermore, in accordance with some embodiments of the present invention, the material includes PDMS.

Furthermore, in accordance with some embodiments of the present invention, the transfer member includes a stamp with protrusions in the form of the pattern.

Furthermore, in accordance with some embodiments of the present invention, the method includes forming the stamp by spin coating a material on a silicon mold that includes grooves in the form of the pattern.

Furthermore, in accordance with some embodiments of the present invention, a surface of a groove of the grooves is textured such that a face of a protrusion of the protrusions that is formed in that groove substantially replicates the texture of the textured groove surface.

Furthermore, in accordance with some embodiments of the present invention, the material includes PDMS.

Furthermore, in accordance with some embodiments of the present invention, the method includes applying photolithography and etching to fabricate the groove.

There is further provided, in accordance with some embodiments of the present invention, a nano-imprint lithography apparatus including: a stamp with fine protrusions in the form of a pattern; and a printing pad for pressing the stamp onto an imprint resist coating on a surface of a substrate surface so as to imprint a replica of the protrusions in the imprint resist.

There is further provided, in accordance with some embodiments of the present invention, a method for nano-imprint lithography, the method including: applying imprint resist to a surface of a substrate; pressing a pad against a stamp with a pattern of protrusions so as to press the protrusions of the stamp into the imprint resist; hardening the imprint resist; and removing the pad and the stamp from the hardened imprint resist.

BRIEF DESCRIPTION OF THE DRAWINGS

In order to better understand the present invention, and appreciate its practical applications, the following Figures are provided and referenced hereafter. It should be noted that the Figures are given as examples only and in no way limit the scope of the invention. Like components are denoted by like reference numerals.

DETAILED DESCRIPTION OF THE INVENTION

Figure 1:
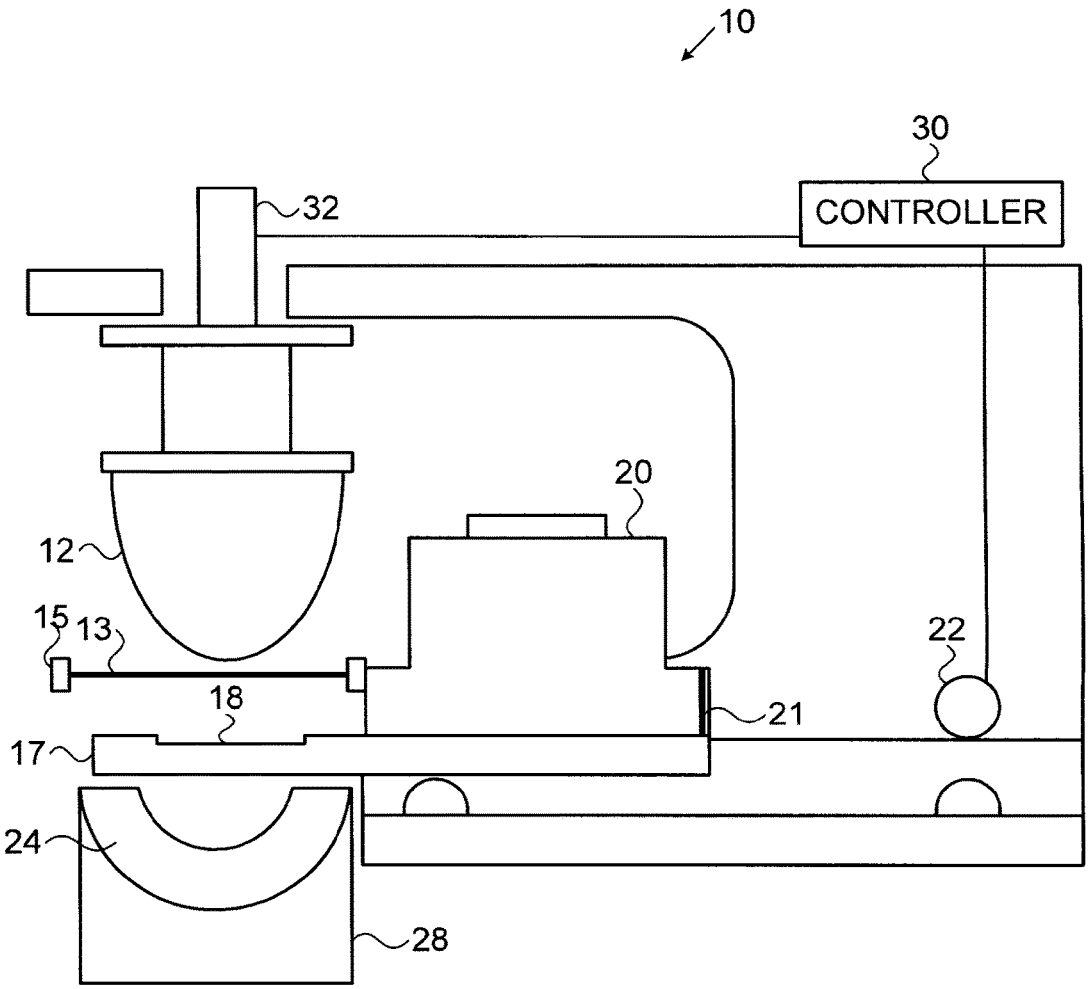
FIG. 1 schematically illustrates a pad printing system, in accordance with embodiments of the present invention.

In the following detailed description, numerous specific details are set forth in order to provide a thorough understanding of the invention. However, it will be understood by those of ordinary skill in the art that the invention may be practiced without these specific details. In other instances, well-known methods, procedures, components, modules, units and/or circuits have not been described in detail so as not to obscure the invention.

Embodiments of the invention may include an article such as a computer or processor readable medium, or a computer or processor storage medium, such as for example a memory, a disk drive, or a USB flash memory, encoding, including or storing instructions, e.g., computer-executable instructions, which when executed by a processor or controller, carry out methods disclosed herein.

In accordance with embodiments of the present invention, pad printing includes using a transfer member (herein used to include a transfer membrane or a stamp) to transfer ink in the form of a pattern from an ink carrier (e.g., inked cliché, pad, bath, or other ink-holding structure) to a substrate surface. The content to be printed (e.g., an image, text, pattern, or other content, any of which is herein referred as an image) may include fine features. For example, a transfer member in the form of a transfer membrane is inserted between a pad of a pad printing system and an ink carrier in the form of a cliché whose grooves or recesses in the form of the pattern or image have been filled with ink. A transfer member in the form of a stamp may be inserted between the printing pad and a bath or pad that includes the ink. As used herein, ink may be understood to include a black or colored ink, paint, or other liquid printing medium, and may be understood to include a conducting ink (e.g., containing suspended conducting particles).

For example, a transfer member in the form of a transfer membrane may be lowered to a top surface of an ink carrier in the form of a cliché. (For the purpose of this description, it is assumed that the cliché remains in a horizontal orientation, with the grooves of the cliché being open upward. Other components and operations of the pad printing surface are described accordingly. Other orientations, such as an oblique or vertically arranged cliché, are possible.) The pad may be lowered to press the transfer membrane against the cliché. The ink is taken up by the bottom surface of the transfer membrane in a form of an ink pattern that substantially duplicates the form on the cliché. For example, each element of the ink pattern (e.g., line, curve or area of ink) duplicates a groove of the cliché.

The pads are raised and the transfer membrane with the ink pattern on its bottom surface is removed from the cliché. The inked bottom surface of the transfer membrane is placed against the substrate. The pad is lowered to press the inked transfer membrane against the substrate surface. When the pad is raised and the transfer membrane is removed, the ink remains on the substrate surface, forming an image as determined by the grooves of the cliché.

For example, the transfer membrane may be made of polydimethylsiloxane (PDMS), or another material that is impermeable to ink. The transfer membrane may be made by spin coating the PDMS in liquid phase onto a flat fabrication surface or substrate that is spun at an appropriate speed to obtain a transfer membrane of the desired thickness (e.g., 50 μm or another thickness). The substrate for the transfer membrane fabrication can be a silicon wafer may be prepared (e.g., coated or treated) so as to control the printing surface properties of the transfer membrane. For example, the fabrication surface may be coated with an anti-stick coating to enable easy removal of the transfer membrane from the fabrication surface.

All or part of the fabrication surface may be roughened (e.g., by coating, sanding, or etching) to produce a roughened printing surface on the transfer membrane (e.g., to facilitate ink retention by the printing surface). For example, a plasma etching process may be applied in a controlled manner to provide a desired texture on the fabrication surface. The use of fluorine-oxygen plasma $SF_6/O_2$ having a flow rate of 20 standard cubic centimeters per minute (SCCM) while applying 155 W of radiofrequency power at a pressure of 100 mTorr may enable effective controlled silicon dry etching. A typical etch rate range is about 3770 Å/minute, applied for a period of time ranging 10 seconds to 2 minutes, may be used to produce a roughness or texture having a typical feature size in the range of about 0.1 μm and 0.5 μm. For example, such a texture may be effective in printing a line whose width is in the range of about 40 μm to about 50 μm. The feature size of the resulting texture may be controlled by varying the above parameters and the time of application. Other texturing methods may be applied (e.g., mechanical roughening, chemical etching, optical heating, or other methods).

Since the transfer membrane may be produced using a simple spin coating process, the cost of replacing a transfer membrane may be negligible as compared with the cost of replacing a pad. Thus, since the transfer membrane protects the printing pad from direct contact with the cliché, the ink, and the substrate surface, the useful lifetime of the (more expensive) pad may be greatly extended (as compared with the lifetime of a printing pad in a conventional pad printing system). In addition, properties of the printing surface of the transfer membrane are highly controllable and cleaning the transfer membrane is relatively (to cleaning a printing pad) simple and fast The dimensions of the frame may be made larger than the size of the image to be printed. In this manner, distortion of the inked portion of the transfer membrane during printing may be minimized. Minimizing distortion of the transfer membrane may increase accuracy of the printing, thus enabling accurate printing of fine features of images. As used herein, a fine feature refers to a feature whose critical dimension (e.g., line width) is no larger than 100 μm, no larger than 70 μm, or no larger than 50 μm. Variations in (e.g., precision of) the critical dimension of the fine feature may be small enough to enable printing of lines with a fine resolution (spacing between adjacent lines) of about 5 μm. More particularly, a fine feature may refer to a feature whose critical dimension is no larger than 10 m, or whose variations in critical dimensions no larger than ±1.5 μm. As used herein, a fine pattern refers to a pattern (e.g., of cliché grooves, stamp protrusions, or printed pattern) containing features whose critical dimensions, precision of critical dimensions, spacing between features, or a combination of any of the above, correspond to those of fine features.

A pad printing system in accordance with embodiments of the present invention may include a membrane holder for holding the transfer membrane onto the pad. The holder includes a frame that is configured to hold edges of the transfer membrane. For example, a circular frame may be provided to hold a circular transfer membrane. An edge region of the transfer membrane may be thickened to facilitate holding by the frame. Alternatively or in addition, a membrane may be held directly to a printing pad.

In accordance with embodiments of the present invention, a cliché may include (crystalline) silicon in which the grooves are formed using silicon photolithography and etching techniques. The dimensions of the grooves may thus be formed with a precision as small as less than ±0.5 m. Thus, printing of a fine pattern or fine feature may be enabled. The side walls and the bottom of the groove may be sufficiently smooth so as not to affect printing.

The precision of groove formation in silicon may enable formation of a pattern of small groove component in close proximity to one another (e.g., separated by thin walls). For example, such a pattern of groove components may function as a single larger groove. Use of small groove components may be advantageous. For example, use of small groove components may result in formation of an ink pattern on the transfer membrane that includes substantially duplicated small pattern elements. The quantity of ink for a small pattern element may adhere to the transfer membrane surface better, and under a greater variety of conditions, than a larger quantity of ink for a large pattern element. The small pattern elements are pressed onto the substrate surface to form a printed image. During pressing, each of the small pattern elements spreads slightly when transferred to the substrate surface to form an element of the printed image. The spreading may be sufficient that the pattern of small printed elements is printed as a single large printed element, e.g., as would by been formed by a single groove with the same overall dimensions as the pattern of groove components. For example, a line to be printed may be represented on the cliché as a row of dot-like grooves, rather than by a single elongated groove.

Formation of a cliché out of silicon may be advantageous over formation of a cliché out of a metal or another material. For example, when a printing pad is pressed against a silicon cliché, the force that must be applied to the pad to effectively transfer ink to the pad may be less than the force that would be required with a metal cliché. As a result, wear of the pad surface may be reduced by use of a silicon cliché. Furthermore, since, when lower force is applied, ink does not penetrate as deep into the pad surface, the frequency with which the pad is to be cleaned or replaced may be reduced.

Surfaces of a cliché formed out of silicon may be coated or treated to control the surface properties. For example, a coating on an upper surface of the cliché (the side that comes into contact with the transfer membrane) may be provided with a hardening coating (e.g., alumina). The hardening coating may allow the upper surface to withstand repeated passes of a doctor blade. For example, the pad printing system may include one or more stainless steel blades that are scraped across the cliché surface to spread ink into the grooves, or to wipe away excess ink that did not fit into the grooves during spreading.

Surfaces of the groove side walls may be coated to facilitate ink pickup by the transfer membrane. For example, a surface of the groove side wall or bottom may be coated with a material that repels the ink (e.g., polytetrafluoroethylene, such as Teflon®, or another material that repels ink).

In accordance with an embodiment of the present invention, a transfer member may include a stamp, and the ink carrier may then include a structure (e.g., pad or bath) for inking protrusions on the stamp surface. A mold for fabrication of a printing stamp may be formed out of silicon. As described above (with regard to cliché formation), photolithography and etching techniques may be utilized to accurately form the mold.

The mold may include grooves in the form of fine features. The mold may be coated or treated to control surface properties.

The stamp may be formed by spin coating the stamp material (e.g., PDMS or silicone rubber) on the mold surface. The spin coated material, when peeled off of the mold, is in the form of a stamp. Stamp material that fills the groove on the mold forms a fine raised protrusion on the printing surface of the stamp. The stamp can be also locally coated or treated to control surface properties.

The precision of the mold formation may enable control of roughness of a printing face of the stamp. For example, the bottom of a groove may be deliberately formed with a controlled roughness. When a stamp is formed on that mold, the raised protrusion that was formed in the roughened groove may have a roughened face. A rough face may pick up ink more effectively than a smooth surface of the same material. Thus, the rough protruding surface may result in better print quality than would be possible with a smooth surface. For example, hydrophilicity of PDMS may be increased by oxygen plasma treatment.

The stamp may be inked to transfer an image that if formed by the raised protrusions to a substrate surface. For example, the protrusions may be inked by immersion in a bath of ink, or by pressing against an ink-saturated pad. As another example, the protrusions may be inked by insertion into ink-filled grooves of a cliché. Grooves of the cliché may be similar to those of the mold used to form the stamp, or may be somewhat wider to facilitate dipping of the protrusions into the grooves.

FIG. 1 schematically illustrates a pad printing system, in accordance with embodiments of the present invention.

Pad printing system 10 is configured to use transfer member 13 to transfer ink in the form of a pattern from an ink carrier 17 to a substrate 24.

For example, ink carrier 17 may represent a cliché plate having a pattern that is formed by one or more grooves 18. (For the sake of simplicity and clarity, only a single groove 18 is shown and the size of groove 18 relative to the cliché plate is shown as larger that would be typical.) In this example, transfer member 13 may represent a transfer membrane. A transfer membrane is substantially featureless, except for possibly some amorphous texturing or other controlled surface properties or preparation.

As another example, transfer member 13 may represent a stamp (e.g., the stamp having the form of a thin membrane-like base from which the protrusions protrude) having a pattern of protrusions in the form of the pattern to be transferred. In this case, ink carrier 17 may represent a shallow ink bath, a pad that is saturated with ink, a patterned shallow ink bath (resembling a cliché) in which ink-filled grooves of ink bath are patterned to match the protrusions of the stamp, or another carrier that may be utilized to ink transfer member 13 in the form of a stamp.

In the example shown, the upper surface of substrate 24 is concave (e.g., a dome, bowl, lens, cover, or other similar object). In other examples, an upper surface of substrate 24 may be convex, flat, angular, faceted, or otherwise shaped.

Pad printing system 10 is configured to alternately bring transfer member 13 into contact with ink carrier 17 and with substrate 24. For example, controller 30 may be configured to operate lateral motion mechanism 22 to, in turn, bring ink carrier to ink cup 20 and to below transfer member 13. For example, controller 30 may include electronic circuitry or a mechanical mechanism that coordinates relative motion of ink carrier 17, ink cup 20, transfer member 13, substrate 24, and printing pad 12. (For example, in some systems lateral motion mechanism 22 may be configured to move printing pad 12 while ink carrier 17 remains in a fixed position. In other systems, lateral motion mechanism 22 may be configured to move ink carrier 17 while printing pad 12 remains stationary. Other combinations of lateral motions are possible. For the sake of simplicity, in FIG. 1 and in other Figures referenced herein, lateral motion mechanism 22 is shown as moving ink carrier 17 while other components of pad printing system 10 remain stationary with regard to lateral motion.)

Controller 30 may include a processor that is configured to operate in accordance with programmed instructions that are stored in appropriate memory or data storage devices.

Transfer member 13 may be held by membrane holder 15. For example, membrane holder 15 may be in the form of a frame that holds all or part of the periphery of transfer member 13. Transfer member 13 may be alternately brought by lateral motion mechanism 22 to be adjacent to ink carrier 17 and to substrate 24. Lateral motion mechanism 22 or a different motion mechanism, e.g., that is associated with substrate holder 28, may sequentially bring different substrates 24, or different parts of a single substrate, adjacent to transfer member 13. For example, substrate holder 28 may be configured to translate or rotate substrate 24. Alternatively to being held by membrane holder 15, transfer member 13 (having a membrane-like form) may be placed directly on (e.g., fitted over or clamped to) printing pad 12.

For example, ink carrier 17 may be in the form of a cliché plate. When the clichéplate is positioned below ink cup 20, ink is dispensed by ink cup 20 onto the facing surface of the cliché plate (the surface that includes groove 18). During dispensing of the ink, the cliché plate may be moved (e.g., by lateral motion mechanism 22) relative to ink cup 20 in order to spread the dispensed ink over the surface of the cliché plate. Spreading the ink may ensure that ink fills every groove 18. A flood bar or one (back) side of blade 21 (e.g., a doctor blade) may be moved along the surface of the clichéplate in order to facilitate uniform spreading of the ink. Further relative motion, e.g., in an opposite direction, may enable removal of excess ink (ink that is on the surface of the clichéplate outside of grooves 18) from the surface of the cliché plate. For example, the same or a different blade 21 may be scraped along the surface of the cliché plate to remove the excess ink (e.g., to a receptacle adjacent to the cliché plate). Blade 21 may be shaped (e.g., with a hooked or J-shaped profile, or otherwise shaped) so as to facilitate ink spreading when moved in one direction relative to a cliché plate, and excess ink removal when moved in the opposite direction. Similar inking activities may be performed when ink carrier 17 provides ink for a transfer member in the form of a stamp.

Controller 30 may operate pad motion mechanism 32 to raise or lower printing pad 12. Pad motion mechanism 32, or a related (and coordinated) mechanism, may be operated to raise or lower membrane holder 15.

For example, groove 18 may be filled with ink and positioned adjacent to a transfer member 13 in the form of a membrane or stamp. Pad motion mechanism 32 may then be operated to lower printing pad 12 and transfer member 13 to ink carrier 17. Printing pad 12 presses transfer member 13 against ink carrier 17 in order to cause the ink within groove 18 to adhere to transfer member 13. Once transfer member 13 is inked, pad motion mechanism 32 may be operated to raise printing pad 12 (and transfer membrane 14) away from ink carrier 17. (When transfer member 13 is in the form of a stamp, ink carrier 17 may not include grooves in all cases. When ink carrier 17 does not include grooves, ink carrier 17 may include a bath of ink, a pad saturated with ink, or other structure for holding ink.)

After transfer member 13 is inked, substrate 24 may be brought adjacent to transfer member 13 (e.g., by operation of lateral motion mechanism 22, substrate holder 28, or both). Pad motion mechanism 32 may then operate to lower pad 12 and transfer member 13 against substrate 24. Printing pad 12 presses inked transfer member 13 against substrate 24. Ink on transfer member 13 then adheres to the surface of substrate 24. Once the ink pattern is transferred to substrate 24, printing pad 12 and transfer member 13 may be raised.

Printing pad 12 may be shaped to accommodate a particularly shaped substrate 24. Alternatively or in addition, two or more printing pads may be cooperated concurrently in order to press transfer member 13 against a substrate with a large surface, or with a complex shape. Transfer member 13 prevents direct contact between printing pad 12 and both ink carrier 17 and substrate 24. Thus, no ink comes into contact with printing pad 12. Furthermore, there is not direct rubbing or scraping between printing pad 12 and ink carrier 17 or substrate 24. Avoiding contact between printing pad 12 and ink may prevent deterioration of printing pad 12.

In accordance with some embodiments of the present invention, ink carrier 17 is in the form of a cliché plate with grooves. The cliché plate and the grooves may be configured to enable printing a fine pattern that includes fine features, or another pattern or feature.

Figure 2:
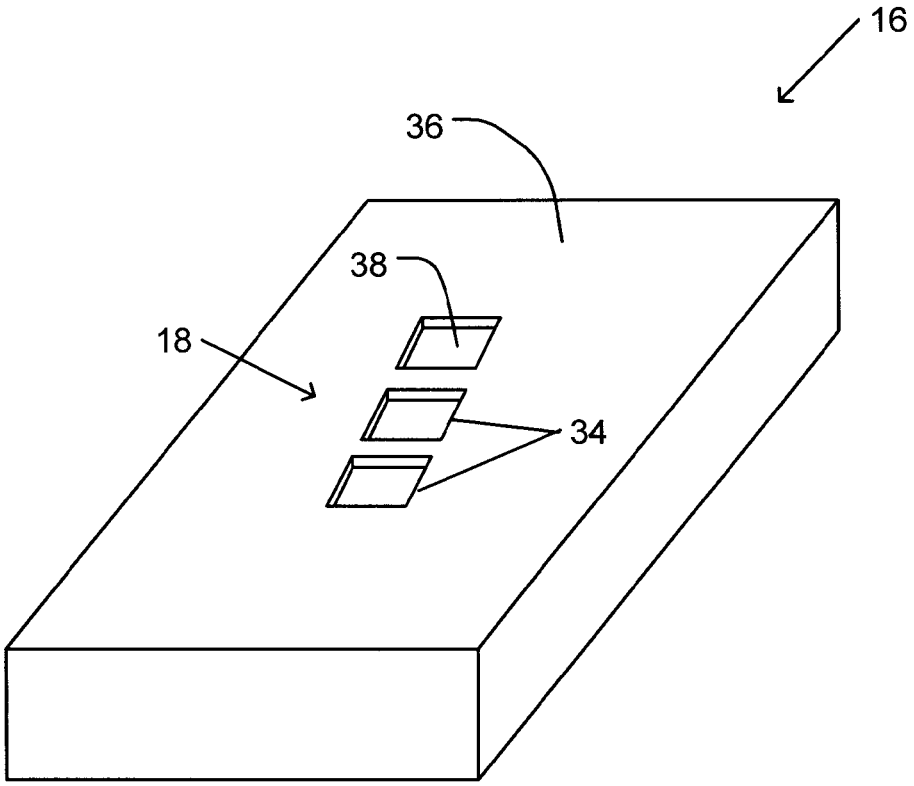
FIG. 2 schematically illustrates a cliché plate, in accordance with an embodiment of the present invention.

FIG. 2 schematically illustrates a cliché plate for pad printing, in accordance with an embodiment of the present invention.

Part or all of clich plate 16 may be formed out of silicon that is specially coated or treated to control the surface properties. For example, a silicon wafer may be placed on a backing. The backing may prevent the silicon wafer from breaking or fracturing during use.

For example, at least a portion of cliché plate 16 that includes groove 18 may be made out of silicon. In this manner, groove 18 may be formed by using standard silicon wafer photolithography and etching techniques, as are utilized, for example, in producing integrated circuits. Thus, tolerances and precision in producing groove 18 may be similar to those of integrated circuits. On the other hand, for a non-silicon cliché plate, laser machining is limited in attainable precision by the relatively long wavelength of the laser.

When fine shaping of groove 18 is enabled, a single groove 18 may include a plurality of groove components 34. For example, groove components 34 may be in the forms of rectangular or square indentations, round indentations, polygonal indentations, or otherwise shaped indentations. Thus, the volume or mass of ink with which each groove component 34 is filled may be a fraction of the total volume or mass of groove 18. Division of a groove 18 into smaller groove components 34 may inhibit or prevent separation of ink from the transfer membrane, or may inhibit or prevent distortion of the image that is transferred to the substrate.

When cliché plate 16 is formed out of silicon, or a similar material that may be specially coated, one or more coatings may be coated onto various surfaces of cliché plate 16. The coatings may be applied using known silicon coating techniques. Such coatings may include, for example, scratch-resistant coating 36 and ink repelling coating 38.

For example, ink repelling coating 38 may include a fluorocarbon film deposited from a $C_4F_8$ plasma by a passivation process.

Scratch-resistant coating 36 may include a hardened material. Scratch-resistant coating 36 may be coated on a surface of cliché plate 16 that is scraped by a blade or other component during printing (e.g., to spread ink or to remove excess ink). Scratch-resistant coating 36 may thus prevent scratching of cliché plate 16 by the blade. Thus, the lifetime of cliché plate 16 may be extended.

Ink repelling coating 38 may be placed on one or more interior side walls of a groove 18 or groove component 34. For example, ink repelling coating 38 may be coated onto a bottom or side wall of a groove 18 or groove component 34. Ink repelling coating 38 may inhibit or prevent ink from adhering to surfaces of a groove 18 or groove component 34. Thus, ink may be transferred efficiently from a groove 18 or groove component 34 to a transfer membrane printing surface that is specially prepared to control surface properties. Such efficient ink transfer may enable more accurate printing, and may inhibit or prevent buildup of ink within a groove 18 or groove component 34 (that could effectively clog the groove or groove component). For example, efficient ink transfer may prevent or inhibit buildup of conducting particles of conducting ink that may settle in the type or rough surfaces that are typical of metal cliché plates.

In accordance with some embodiments of the present invention, a transfer member may be in the form of a transfer membrane.

Figure 3:
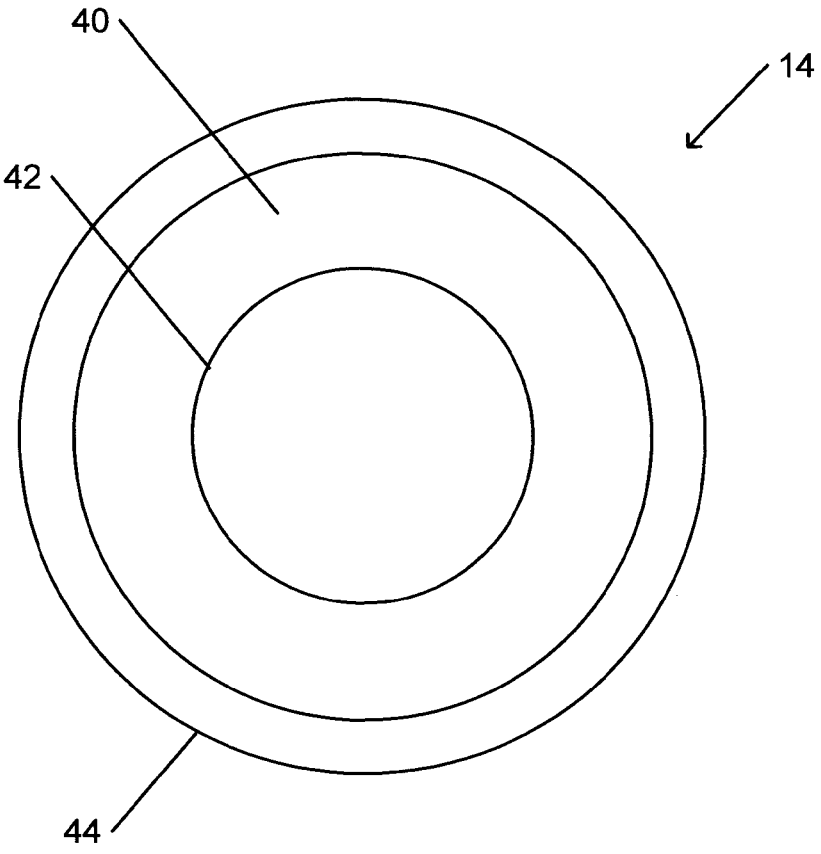
FIG. 3 schematically illustrates a transfer membrane for pad printing, in accordance with an embodiment of the present invention.

FIG. 3 schematically illustrates a transfer membrane for pad printing, in accordance with an embodiment of the present invention.

Transfer membrane 14 may be made of or include PDMS, or may include parylene, polyimide of similar materials. For example, transfer membrane 14 may be produced by a spin coating technique, or by a vacuum deposition technique. The surface onto which the material is spin coated or vacuum deposited may be a silicon wafer. The surface on which transfer membrane is spin coated may be prepared such as to control the properties (e.g., texturing) of the printing surface of the membrane.

During printing, central portion 42 may be pressed by a printing pad against a cliché or substrate surface. Outer portion 44 may be held by a membrane holder (e.g., a frame that grips all or part of outer portion 44). For example, outer portion 44 may be thickened or strengthened to facilitate holding by the membrane holder.

During pad printing, a printing pad may press central portion 42 of transfer membrane 14 while outer portion 44 is held by a membrane holder. Thus, the ink pattern from the cliché is transferred to central portion 42. In this case, most stretching of transfer membrane 14 may take place in intermediate portion 40 of transfer membrane 14. Stretching in central portion 42 may thus be minimized or reduced. Reduced stretching of central portion 42 may thus improve accuracy of image transfer from the cliché to the substrate and enable printing of fine (e.g., micrometer sized) features.

Transfer membrane 14 may be made of materials that are not impaired by conductive (e.g., silver) ink. Examples of such materials include PDMS, parylene, or polyimide.

Referring to FIG. 1, pad printing system 10 may be operated in accordance with a method for pad printing, e.g., of fine features. Operation of pad printing system 10 may be controlled by controller 30. Alternatively or in addition, pad printing system 10 may be operated manually by a human operator, or by the operator working in coordination with controller 30.

Figure 4A:
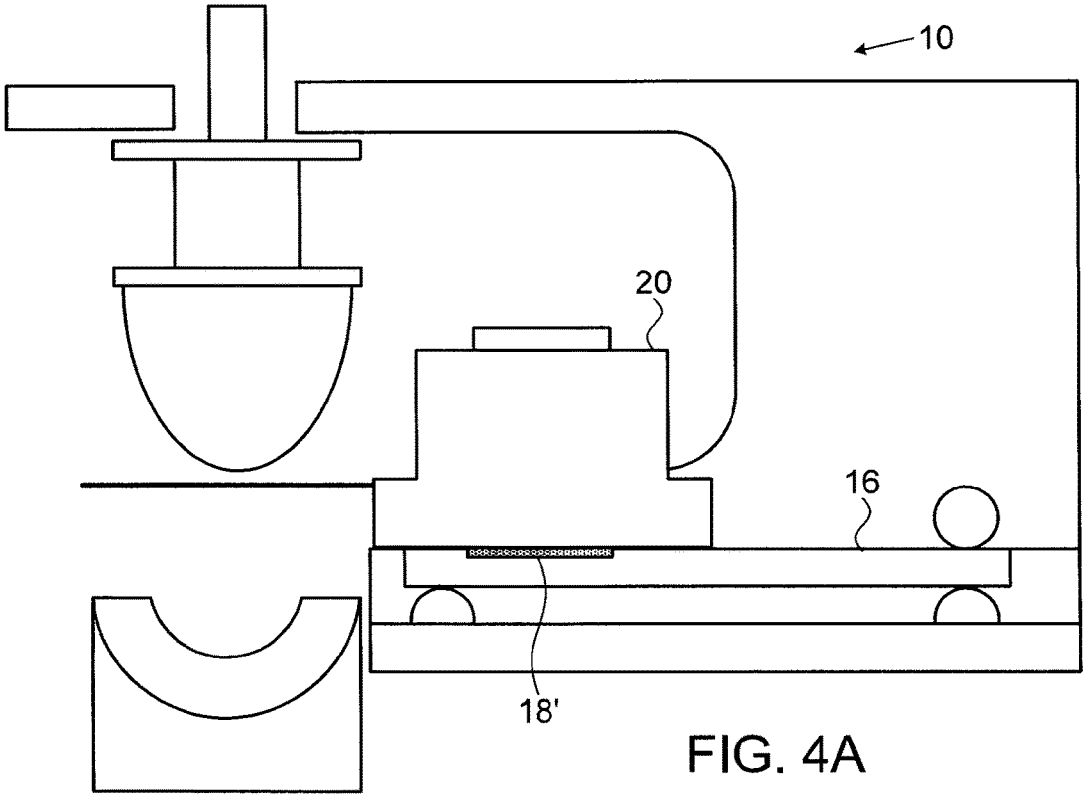
FIG. 4A schematically illustrates a cliché inking step of a method for pad printing, in accordance with an embodiment of the present invention.

FIG. 4A schematically illustrates a clichéinking step of a method for pad printing, in accordance with an embodiment of the present invention.

Ink cup 20 dispenses ink onto cliché plate 16 to form ink-filled groove 18'.

Figure 4B:
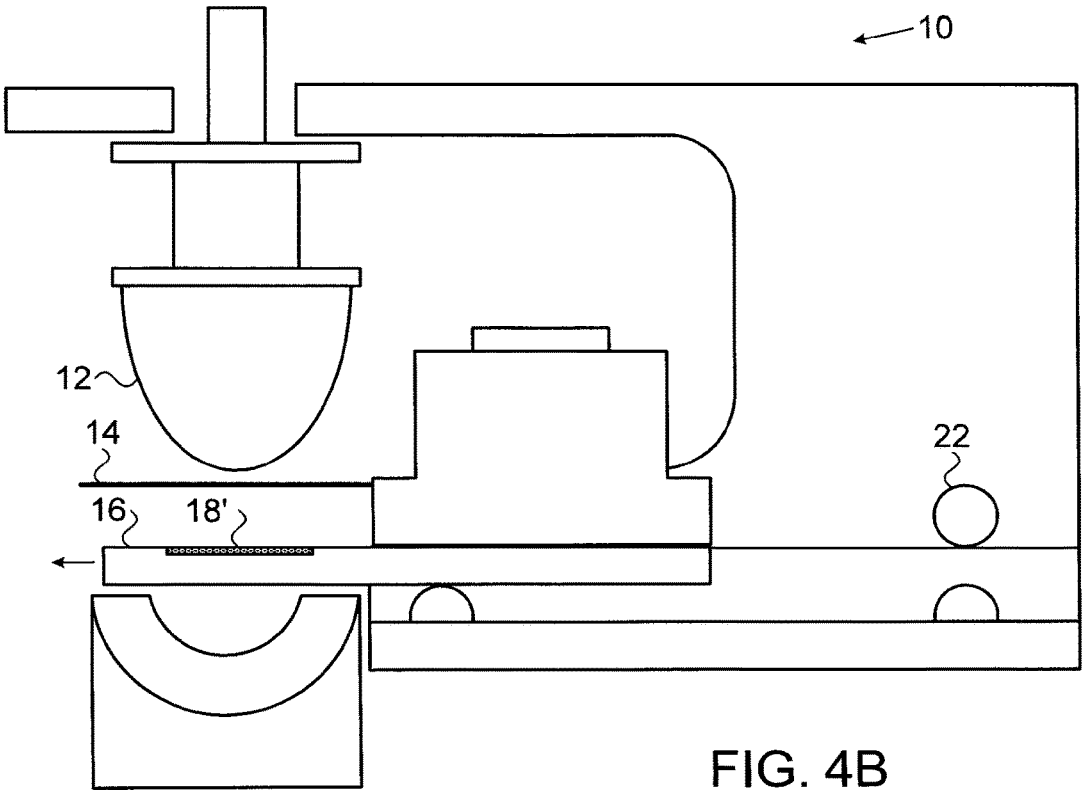
FIG. 4B schematically illustrates a step with an inked cliché of a method for pad printing, in accordance with an embodiment of the present invention.

FIG. 4B schematically illustrates a step with an inked cliché of a method for pad printing, in accordance with an embodiment of the present invention.

Lateral motion mechanism 22 is operated to move ink-filled groove 18' (to which ink has been restricted by action of a doctor blade or similar mechanism) to transfer membrane 14.

Figure 4C:
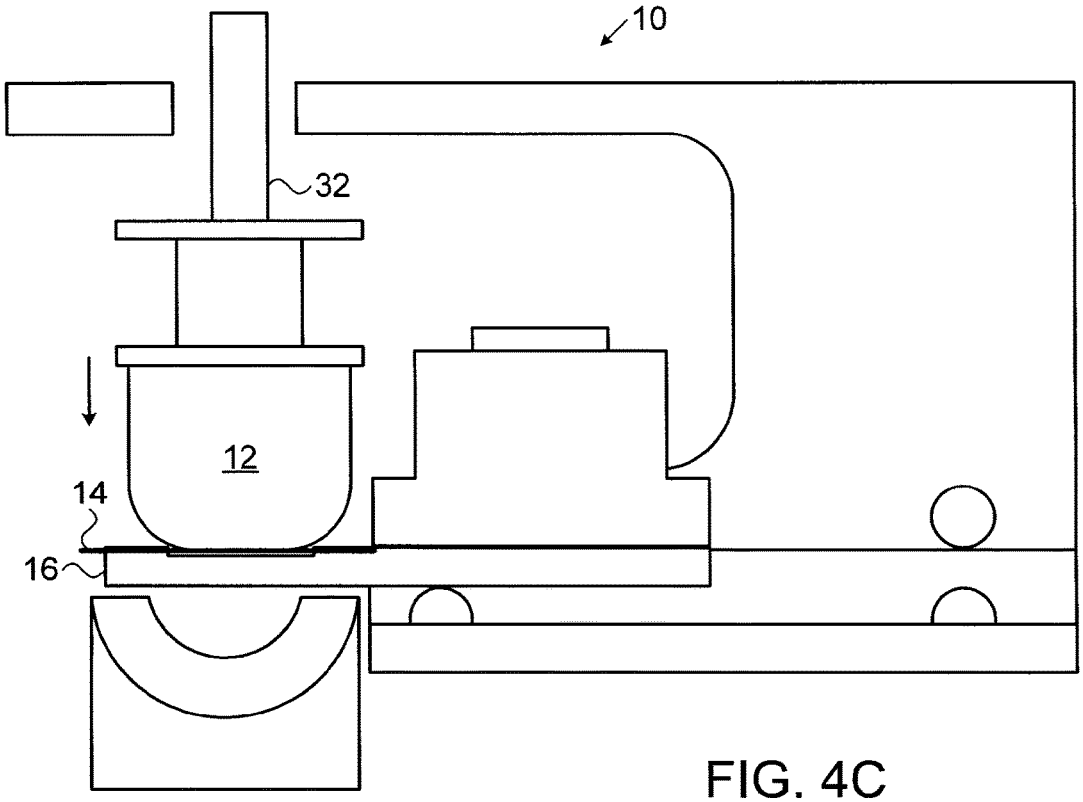
FIG. 4C schematically illustrates a transfer membrane inking step of a method for pad printing, in accordance with an embodiment of the present invention.

FIG. 4C schematically illustrates a transfer membrane inking step of a method for pad printing, in accordance with an embodiment of the present invention.

Transfer membrane 14 is lowered to contact cliché plate 16. Pad motion mechanism 32 is operated such that printing pad 12 presses transfer membrane against cliché plate 16.

Figure 4D:
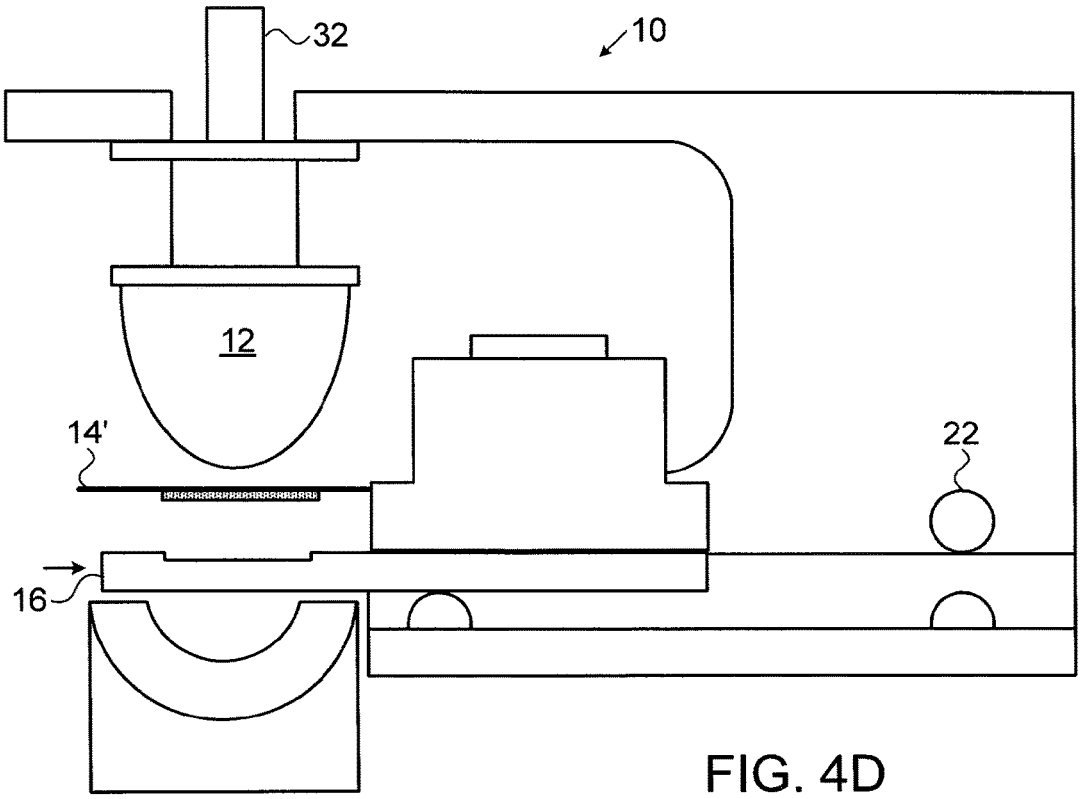
FIG. 4D schematically illustrates a step with an inked transfer membrane of a method for pad printing, in accordance with an embodiment of the present invention.

FIG. 4D schematically illustrates a step with an inked transfer membrane of a method for pad printing, in accordance with an embodiment of the present invention.

Pad motion mechanism 32 is operated to raise printing pad 12 and release the pressure on inked transfer membrane 14', which is also raised. Lateral motion mechanism 22 is operated to move cliché plate 16 away from inked transfer membrane 14'.

Figure 4E:
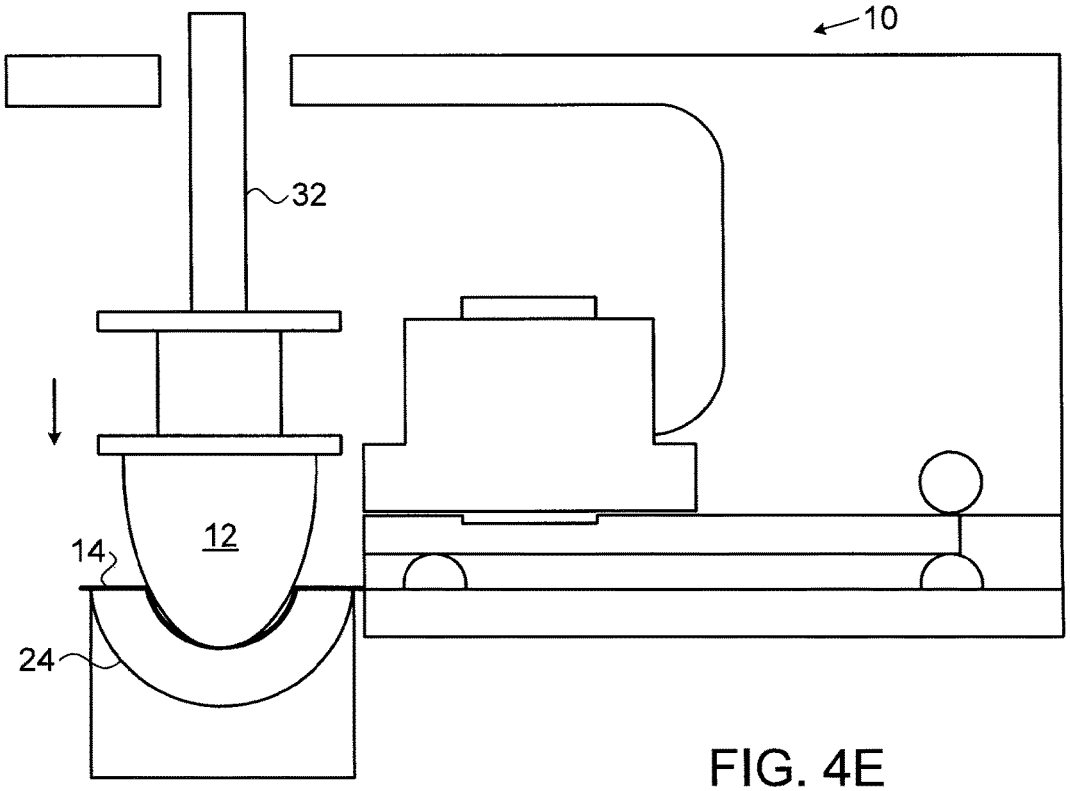
FIG. 4E schematically illustrates an image printing step of a method for pad printing, in accordance with an embodiment of the present invention.

FIG. 4E schematically illustrates an image printing step of a method for pad printing, in accordance with an embodiment of the present invention.

Transfer membrane 14 is lowered to substrate 24. Pad motion mechanism 32 lowers printing pad 12 to press transfer membrane 14 against substrate 24. The pressure causes the shape of transfer membrane 14 to conform to the shape of substrate 24.

Figure 4F:
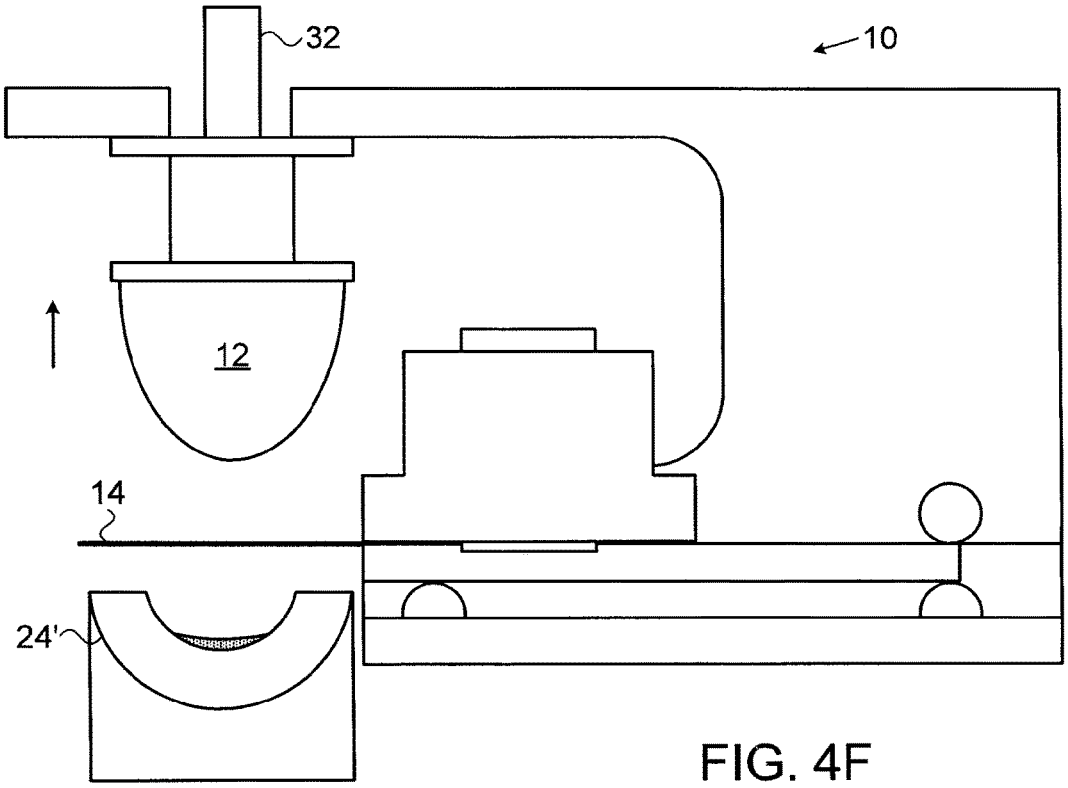
FIG. 4F schematically illustrates a step with a printed substrate of a method for pad printing, in accordance with an embodiment of the present invention.

FIG. 4F schematically illustrates a step with a printed substrate of a method for pad printing, in accordance with an embodiment of the present invention.

Pad motion mechanism 32 is operated to lift printing pad 12. Transfer membrane 14 is also raised. Printed substrate 24' is printed with an ink pattern that duplicates the pattern on cliché plate 16. Concurrently, ink is dispensed onto cliché plate 16 by ink cup 20 (as shown in FIG. 4A).

In accordance with an embodiment of the present invention, a transfer member may include a stamp. A mold may be fabricated out of silicon using techniques described above (for fabricating a cliché out of silicon). The mold may be used for producing a stamp for printing a fine pattern that includes fine features, or another type of pattern or feature.

Figure 5:
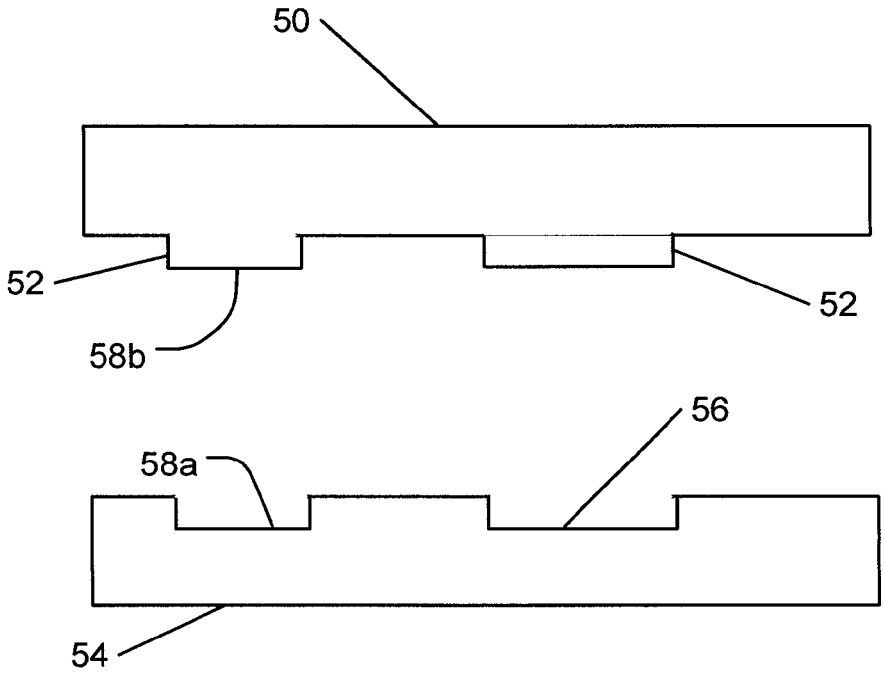
FIG. 5 schematically illustrates a stamp for printing, and a mold for fabricating the stamp, in accordance with an embodiment of the present invention.

FIG. 5 schematically illustrates a stamp for printing and a mold for fabricating the stamp, in accordance with an embodiment of the present invention.

Stamp 50 includes protrusions 52 in the form of an image to be printed. Stamp 50 may be made out of PDMS or another suitable material. When printing with stamp 50, faces **58*b* of protrusions 52 may be inked. The inked faces 58*b*** may then be pressed against a substrate surface on which the ink image is to be printed. The ink image is thus transferred to the substrate surface.

Mold 54, made of silicon (e.g., in wafer form) may be utilized to fabricate stamp 50. Mold 54 includes grooves 56 for forming protrusions 52. Grooves 56 of mold 54 may be accurately fabricated in silicon using photolithography and etching techniques. For example, mold 54 may be in the form of a disk (whose cross section is shown in FIG. 5). PDMS in liquid form may be deposited on mold 54 while mold 54 is being spun. The PDMS that is thus spin coated on mold 54 fills grooves 56. Thus, the hardened PDMS, when removed from mold 54, includes protrusions 52.

Faces 58*b* of protrusions 52 may be roughened or textured to facilitate holding ink. For example, when fabricating a groove 56, bottom 58*a* of that groove 56 ay be deliberately textured in a manner that corresponds to, or substantially replicates, the desired texturing of face 58*b*. Thus, when formed by spin coating, face 58*b* of protrusions 52 substantially replicates the texture of bottom 58*a* of groove 56.

In accordance with an embodiment of the present invention, a pad printing system and stamp may be configured for use in nano-imprint lithography. In nano-imprint lithography, a stamp may be pressed by the printing pad, into a substrate surface that is covered with an imprint resist. The imprint resist may include a thermoplastic polymer or an ultraviolet-curable polymer. Pressing the protrusions of the stamp into the liquid imprint resist may imprint a replica of the pattern of the protrusions onto the resist. The imprinting process removes the resist from the regions of contact of the protrusions with the substrate surface. Imprinting may begin from a first point of contact and spread laterally along the stamp. In addition, capillary forces may assist in pulling the protrusions of the stamp into the liquid imprint resist. Use of the printing pad to press the stamp may enable conformity to an uneven (e.g., wavy) substrate and may prevent trapping of air by the stamp. After imprinting, the imprint resist may be subjected to conditions (e.g., heat, ultraviolet radiation, or other conditions) that cause the imprint resist to polymerize and harden to form a solidified material. After polymerization, the stamp may be removed from the substrate by lifting the pad, thus exposing the imprinted pattern. Removing the stamp by lifting the pad may enable removal by application of a smaller force than would be required were the stamp to be mounted on a solid base. The reduced force may reduce or avoid damage to the stamp or to the imprinted pattern. The stamp and stamp protrusions may be specially treated (e.g. when produced, prior to pressing into the imprint resist, or both) to enable removal of the stamp without damaging or disturbing the imprinted pattern.

Figure 6A:
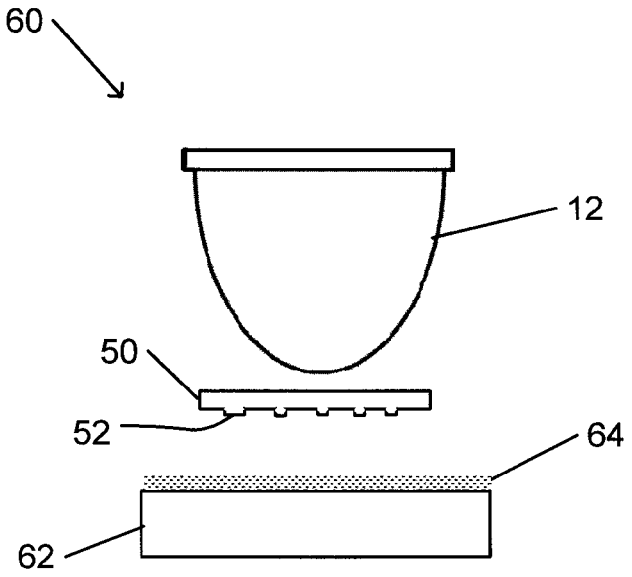
FIG. 6 schematically illustrates a pad printing apparatus configured for nano-imprint lithography, in accordance with embodiments of the present invention.
FIG. 6B schematically illustrates the pad printing apparatus of FIG. 6A after imprinting.

FIG. 6A schematically illustrates a pad printing apparatus configured for nano-imprint lithography, in accordance with embodiments of the present invention. In nano-imprint lithography apparatus 60, printing pad 12 may press protrusions 52 of stamp 50 into imprint resist 64 on lithography substrate 62.

Figure 6B:
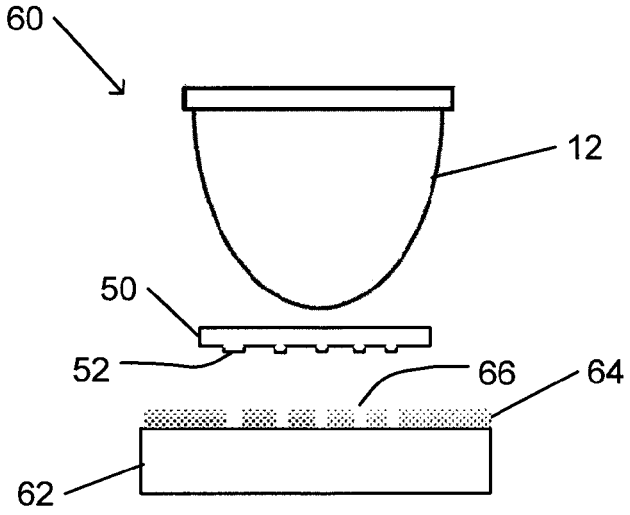

FIG. 6B schematically illustrates the pad printing apparatus of FIG. 6A after imprinting. After polymerization of imprint resist 64, and after removal of stamp 50 from lithography substrate 62, imprint resist 64 is imprinted with a pattern of grooves 66 that correspond to protrusions 52 on stamp 50.

The invention claimed is:

1. An apparatus for pad printing, the apparatus comprising:

a crystalline silicon cliché including a lithographically produced fine pattern of grooves that are configured to be filled with ink;

a printing pad that is configured to be pressed alternatively against the cliché when the grooves are filled with ink and against a substrate so as to transfer the pattern to the substrate; and a transfer member with a roughened bottom surface to insert between the printing pad and the cliché when the pad is pressed against the cliché and between the printing pad and the substrate when the pad is pressed against the substrate.

2. The apparatus of claim 1, wherein a surface of the cliché is coated to resist scratching.

3. The apparatus of claim 1, wherein a surface within a groove of the pattern of grooves is coated to repel ink.

4. The apparatus of claim 1, wherein the transfer member comprises a transfer membrane.

5. The apparatus of claim 1, wherein the transfer member comprises PDMS.

6. The apparatus of claim 1, wherein the transfer member comprises a stamp with protrusions in a form of the pattern such that when the pad is pressed against the cliché , the protrusions are inserted into the grooves of the cliché.

7. A method for pad printing, the method comprising:

applying photolithography and etching to crystalline silicon to fabricate a cliché plate of fine grooves that form a pattern;

filling the grooves of the cliché plate with ink;

pressing a pad against a transfer member with a roughened bottom surface and that is inserted between the pad and the cliché plate so as to press the transfer member against the cliché to transfer the pattern of the grooves to an inked pattern on the transfer member; and pressing the pad against the transfer member with the inked pattern when the transfer member is inserted between the pad and a substrate to print the pattern on the substrate.

8. The method of claim 7, further comprising applying a coating to a surface of the cliché plate.

9. The method of claim 8, wherein the coating comprises a scratch-resistant coating or an anti-stick coating.

10. The method of claim 7, wherein the transfer member comprises a transfer membrane.

11. The method of claim 10, further comprising forming the membrane by spin coating a material on a rotating roughened surface.

12. The method of claim 11, wherein the material comprises PDMS.

* * * * *